United States Patent [19]

McLain

[11] 4,224,123

[45] Sep. 23, 1980

[54] METHOD AND APPARATUS FOR ELECTROPOLISHING TABLET COMPRESSING TOOLINGS

[75] Inventor: Donald E. McLain, Portage, Mich.

[73] Assignee: The Upjohn Company, Kalamazoo, Mich.

[21] Appl. No.: 3,387

[22] Filed: Jan. 15, 1979

[51] Int. Cl.[2] ..... C25F 3/16; C25F 7/00; C25D 17/28

[52] U.S. Cl. ..... 204/129.55; 204/129.6; 204/224 R; 204/222; 204/297 R; 204/212

[58] Field of Search ..... 204/129.55, 129.6, 224 M, 204/224 R, 225, 212, 297 R, 222, 198–199

[56] References Cited

U.S. PATENT DOCUMENTS

| | | | |
|---|---|---|---|
| 2,430,028 | 11/1947 | Pfann et al. | 204/129.55 X |
| 2,763,608 | 9/1956 | Pool | 204/129.6 |
| 2,934,631 | 4/1960 | Imalis et al. | 204/129.55 X |
| 3,332,869 | 7/1967 | Bent et al. | 204/129.55 X |

FOREIGN PATENT DOCUMENTS

| | | | |
|---|---|---|---|
| 156672 | 1/1952 | Australia | 204/129.55 |
| 4120 | of 1898 | United Kingdom | 204/129.55 |

*Primary Examiner*—John H. Mack

*Assistant Examiner*—D. R. Valentine

*Attorney, Agent, or Firm*—Blanchard, Flynn, Thiel, Boutell & Tanis

[57] ABSTRACT

In the method aspect of the invention, a tablet compressing tool having a concavity at its working end, is placed in a vertically aligned position with the concavity downward, contacted by an electrolyte at only the working tip thereof, and agitated by a circular movement in a horizontal plane while being subjected to a suitable DC current potential. The electrolyte may be conventional.

One effective apparatus for practicing the above method comprises a suitable electrolyte containing tank having cathode means, such as a trough or channel-shaped electroconductive mesh, extending therethrough, and tool clamping means on the upper side of said tank arranged for holding a plurality of said tools aligned in a vertical position and extending into electrolyte within said tank. Said tool clamping means is mounted for circular movement in a horizontal plane and arranged with means including prime mover means for effecting such movement. Suitable electrical connections are made to the cathode means and to the tool for the impressing therebetween of the desired potential.

11 Claims, 4 Drawing Figures

METHOD AND APPARATUS FOR ELECTROPOLISHING TABLET COMPRESSING TOOLINGS

FIELD OF THE INVENTION

The invention relates to a method and apparatus for electropolishing the tooling, often also called punches, utilized by the pharmaceutical industry in tablet compressing machines.

BACKGROUND OF THE INVENTION

The pharmaceutical industry has long used a variety of machines for forming by compression medicinal tablets from suitably prepared powders and such machines have normally employed tooling, often called punches, for contacting such powders and effecting such compression. Inasmuch as such tablets are usually of a rounded, or partially rounded, external contour, said punches will normally have a concave tip on the working end thereof to form the tablet to the desired shape. Further, such punches will frequently have embossed or debossed indicia, such as a symbol, code number or a letter, to produce corresponding recessed or elevated indicia on the tablet surface. This indicia, thereby placed onto the tablet surface, is often very small and the recesses in or elevations on the tablet contacting surface of the punch must be clean and sharp in order to produce an attractive looking product and in fact often in order for the indicia to be readable at all. However, in the normal course of use, the working surfaces of such punches usually become rough and frequently even pitted or otherwise disfigured. This results in an unattractive appearing product, or even one in which the indicia is actually unreadable, and hence the working surface of the punch must in some manner be cleaned and/or repolished to restore it to its original smooth condition before it is acceptable for continued use. However, with effective cleaning and polishing, the useful life of a given punch or set of punches can be greatly extended.

This problem has long been recognized and a variety of means have been proposed for effecting such cleaning and repolishing. The cleaning is necessary for the removal from the punch face of bits of product, i.e. the above-mentioned powders, which may cling thereto and the polishing is necessary for the removal of undesired pits, scratches and other irregularities from the product contacting surface or surfaces of the punch face.

Such previously known methods of cleaning and/or polishing have normally been mechanical in nature but have been difficult to carry out with respect to the relatively small concave surface characteristic of tablet punches and have often been very difficult to carry out effectively with respect to the embossing or debossing indicia therein provided for placing the above-mentioned indicia onto a tablet surface. Further, such cleaning and polishing as has been known in the past has seldom been uniformly effective on such punch surfaces and has been particularly lacking in uniform effectiveness with respect to such indicia.

Accordingly, the objects of the invention include:

1. To provide a method and apparatus for cleaning and polishing the working surface or surfaces of the tooling, usually punches, employed by the pharmaceutical industry in tablet-compressing machines.

2. To provide a method and apparatus, as aforesaid, which will be effective in uniformly polishing the tablet contacting surface, usually a concave surface, at the working end of such punches.

3. To provide a method and apparatus, as aforesaid, which will be effective for uniformly polishing also the embossing or debossing often appearing in such surfaces for the placement of various desired indicia onto the surface of a tablet.

4. To provide a method and apparatus, as aforesaid, which will operate quickly and efficiently and can be handled by personnel relatively unskilled in polishing techniques, as contrasted to the high level of skill required of personnel carrying out mechanical polishing procedures.

5. To provide a method and apparatus, as aforesaid, in which a large number of such punches may be conveniently and easily polished simultaneously.

6. To provide a method and apparatus, as aforesaid, which will produce results of both high quality and a high level of uniformity, such uniformity being both with respect to the entire surface of a given punch and with respect to the surfaces of each of a plurality of punches.

7. To provide a method which can be carried out by apparatus, and to provide such apparatus, which is of sufficient mechanical simplicity as to be easy to operate, capable of frequent and trouble-free use over a long period of time and, further, of sufficient simplicity as to be capable of manufacture and maintenance at a low cost.

8. To provide apparatus, as aforesaid, which can by simple adjustments be rendered capable of handling effectively any desired number of such punches up to the capacity of the machine.

Other objects and purposes of the invention will be apparent to persons acquainted with methods and apparatuses of this general type upon reading the following specification and insepection of the accompanying drawings.

DETAILED DESCRIPTION

Referring first to the method aspects of the invention, it is believed that same will be best understood in connection with specific apparatus for practicing same and hence the following description will deal first with such apparatus and the method aspects of the invention will then become more readily apparent.

Figure 1:
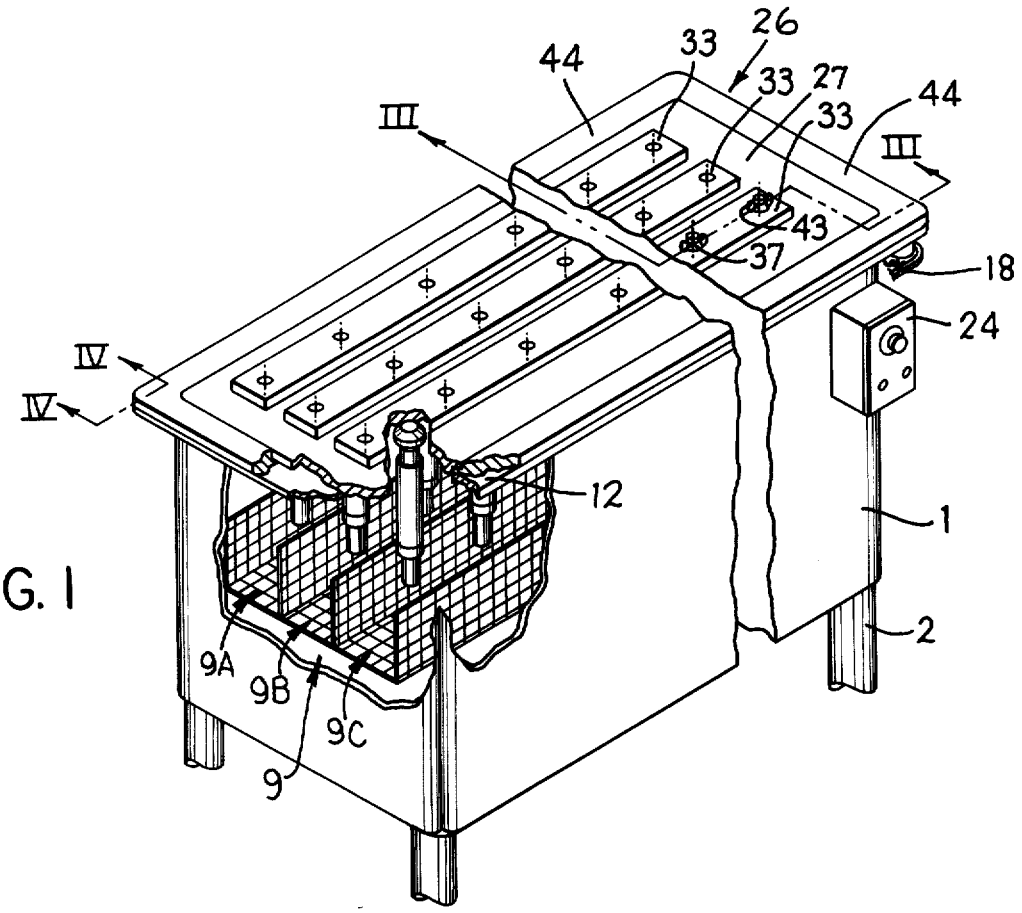
FIG. 1 is an oblique view of a machine embodying an apparatus concept of the invention.

Turning then to the drawings, there is shown therein a generally rectangular tank 1 which is made from or lined with corrosion resistant material, such as stainless steel, fiberglass, or glass, for the containment of any conventional electrolyte designed for electropolishing purposes, and supported upon legs 2 if desired. In this instance said tank is of stainless steel and lined with a plastic material, the stainless steel being indicated at 3 in FIG. 3 and the plastic liner at 4. Suitable brackets 6 are arranged along the inside of said tank walls for supporting cathode brackets 7 and said cathode brackets support a stainless steel cathode screen 8. The cathode screen may be arranged in any of many known designs but it will conveniently define a series of U-channels generally indicated at 9 in FIG. 1, and individually indicated at 9A, 9B and 9C.

Turning now to the upper portion of the tank 1 for an examination of the mechanism by which the punches are supported and agitated in the electrolyte solution, it will be seen that the upper part of the stainless steel portion 3 of the tank walls turns outwardly to define a flange 12 extending around the entire perimeter of the tank 1. Positioned suitably within said glange, here at each of the respective four corners thereof, is a combined thrust and radial bearing of which one appears at 13 for supporting a shaft 14 of the eccentric 16.

Figure 2:
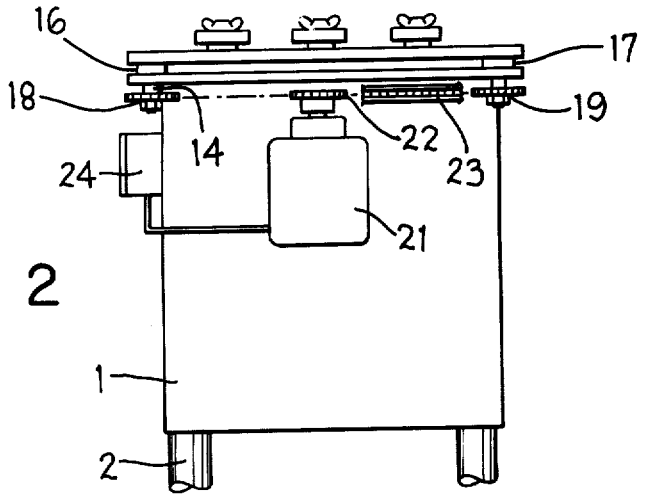
FIG. 2 is an end view of the machine of FIG. 1.

In this embodiment the two eccentrics 16 and 17 (FIG. 2) located at the driving end of the machine, namely the end shown in FIG. 2 of the drawings, is further provided with sprockets 18 and 19, respectively, at the lower ends of each of the downwardly projecting shafts, as the shaft 14 of eccentric 16. A suitable motor 21 is mounted as desired on the tank 1 and its power output shaft is provided with a sprocket 22 which acts through a suitable chain 23 for simultaneously driving both of the sprockets 18 and 19. Any suitable and conventional means including a control switch box 24 may be provided for controlling operation of the motor 21.

The punch support and clamping means 26 comprises a base plate 27 made of any convenient electrically nonconductive material such as fiberboard or sheet plastic. Same is provided with a plurality of openings of which one appears at 28 for reception of the punches as hereinafter further described. A sheet 29 of material of low electrical resistivity, such as copper, is supported at the upper side of the base plate 27, such as by being received into a recess 31 therein. Said conductive sheet 29 is provided with openings 32 therethrough which are aligned with the above-mentioned openings 28. A clamp plate 33, which is also preferably of material of low electrical resistivity, such as copper, is positioned directly above the sheet 29 and is clampable with respect thereto by any convenient means, here the bolt and wing nut assemblies of which one appears in FIG. 3 at 34. In the arrangement shown at 34 a suitable ferrule 36 is threaded into the base plate 27 and is itself internally threaded to receive the bolt 37. Said bolt is threaded into place as shown.

The clamp plate 33 is provided with openings 35 positioned to receive the several bolts 37 and wing nuts of which two appear at 38 and 43 are threaded onto same for clamping said clamp plate 33 with respect to the base plate 27 as desired. A series of recesses of which one appears at 39 is preferably provided, in said clamp plate 33, each thereof being in alignment with the openings 32 and 28, for reception of the respective punches to be cleaned as further described hereinbelow.

An electrical connection 41 is fixed in electrical contact with the clamp plate 33, here by having a portion 42 thereof positioned under one of the wing nuts, as the wing nut 43.

Support means for the base plate 27 is provided by a frame member 44, preferably extending all of the way around the perimeter of the base plate 27. Said frame member may be of any convenient material, preferably corrosion resistant such as stainless steel. It carries on each of its four corners suitable movable supports, which at the corner shown in FIG. 3 includes a radial bearing 46. A short stub shaft 47 extends upwardly as a part of the eccentric 16, same being offset from the shaft 14 and is rotatably received within the bearing 46. The arrangement at the corner associated with the eccentric 17 is identical with that associated with eccentric 16 and illustrated in FIG. 3 and hence needs no separate description. The arrangements at the other two corners are identical with those associated with eccentrics 16 and 17 excepting for the lack at each thereof of driving sprockets corresponding to the sprockets 18 and 19 and hence their construction will also be readily understood without further or specific description relating thereto. Alternatively, however, it will be understood that the support for the frame 44 at the last two named corners, namely the corners remote from those associated with the eccentrics 16 and 17, may by any other desired mechanism such as a conventional ball 46 (FIG. 4) supported and guided within a bearing 47.

Thus, upon energizing of the motor 21, the frame 44 and the clamp mechanism 26 carried thereby will be caused to move with a circular motion and therby carry the punches supported thereon as further described below through a circular path in a horizontal plane.

A further electrical terminal 48 extends with suitable insulation through the wall of the tank 1 and is connected through a tab 49 and the bracket 7 to the cathode screen 8. A nut 51 is provided to tighten the supply cable (not shown) snugly onto the terminal 48.

While the operation of the apparatus, including the installation of the punches therein, is believed obvious from the description set forth thus far, same will be reviewed for the purpose of insuring a complete understanding of the invention.

It will be assumed for purposes of illustration that the tools to be polished are of the shape indicated by the tools T shown in the drawings, each thereof having a cam engaging head $T_1$ with downwardly and inwardly slanting surfaces $T_2$, a shank $T_3$ and a powder engaging surface $T_4$ at the tip $T_5$. Said powder engaging surface in concave as indicated at $T_4$ and will in many cases have embossings or debossings for the purpose of providing desired indicia onto the finished tablet.

Figure 3:
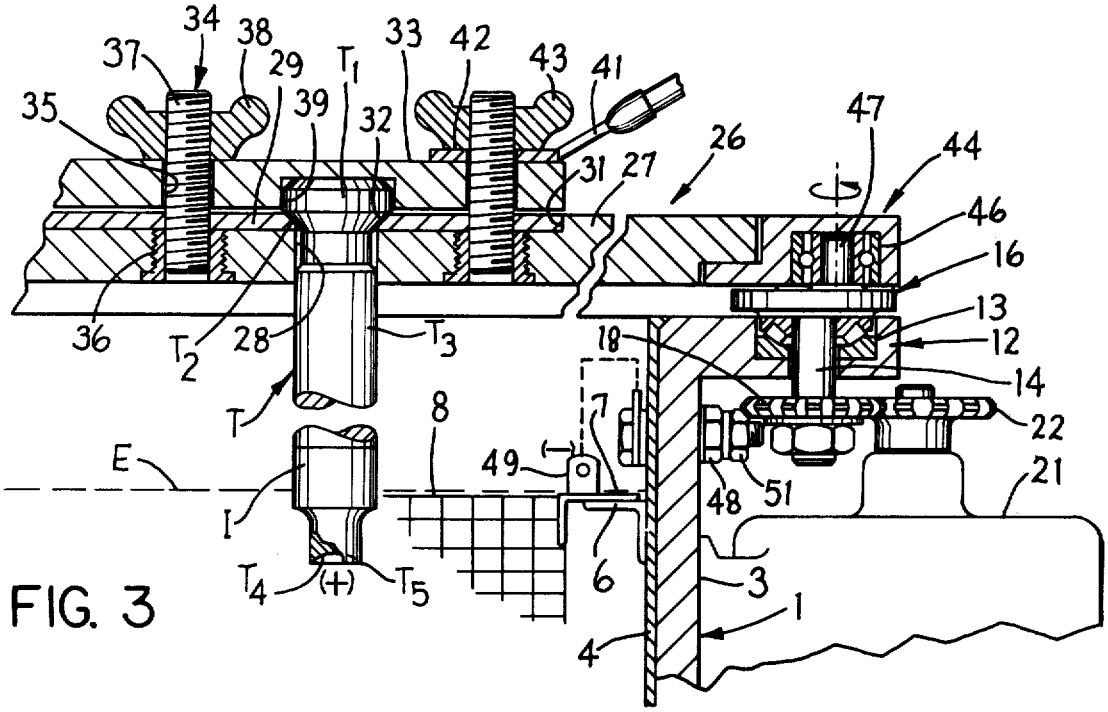
FIG. 3 is a fragmentary section taken on the line III—III of FIG. 1.
Figure 4:
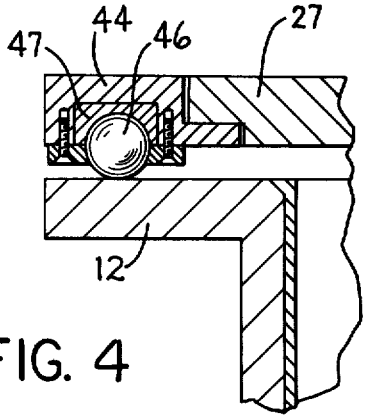
FIG. 4 is an alternate construction taken on line IV—IV of FIG. 1.

Assuming that the electrolyte in the tank 1 is at about the depth indicated by the broken line E in FIG. 3, namely just covering the cathode screen 8, the lower end of the tool T is covered by insulative material I to an extent as shown, namely sufficient to protect all of same excepting only the powder engaging surface $T_4$ from contact with the electrolyte.

With all of the tools T so covered by such insulative material, and with each of the top plates 33 removed, the several tools T are inserted into respective openings 32 and 28 as shown with respect to one of said tools in FIG. 3. The top plates 33 with respect to the several tools are then put back in place with the several bolts 37 projecting through the respective openings 35. The wing nuts including the nuts 38 and 43 are threaded onto said bolts 37 and tightened. This clamps the heads $T_1$ of the several tools T snugly into position and holds them firmly during the subsequent cleaning and polishing operation.

With the tank 1 previously filled with electrolyte as above indicated, the motor 21 is now started to cause the clamp assembly 26 to follow a circular path of a radius determined by the offset between the shafts 14 and 47. The power is not applied to the terminals 41 and 48 and the cleaning and polishing operation proceeds.

The specifics of the electrolyte used together with the voltage, amperage and time of treatment will all vary according to the total exposed surface of the tools being treated and also according to the material from which such tools are made. All of this is within the knowledge of the prior art and therefore needs no detailed discussion. However, by way of specific example, the apparatus here shown has been found to clean and polish tools as set forth below very effectively under the following conditions:

Approximate area of each tool exposed to electrolyte: 0.175 square inch

Preliminary preparation (cleaning): water at 60° C. and drying by airblast of about 60 psi Material of tools: Tool Steel Voltage: 14 volts Amperage: For a test conducted with one tool, an amperage of 2 ½–3 amperes at 14 volts produced good results; in a test involving two punches, a current flow of 5 amperes at 14 volts produced good results and in a test involving ten punches, a current flow of 25 amperes at 14 volts produced good results. Therefore, under the other conditions here present, there appears to be a straight-line relationship of approximately 2 ½ amperes at 14 volts per tool being processed Electrolyte: Ferro-Glo No. 600, Manufactured by Electro-Glo Corp., Chicago, Ill.

Specific Gravity of electrolyte: 1.690–1.7 (this can vary from 1.69 to 1.72)

Temperature: 85° C.–95° C.

Time of treatment: 1.5 minutes

Diameter of circular motion: 1 ½" diameter

Speed of circular motion: The preferred range appropriate to the parameters described above appears to be about 75–95 rpm; a rotational speed of less than substantially 75 rpm fails to remove gas bubbles effectively from the concavity defining the working surface of the tool and a rotational speed greater than substantially 95 rpm effects an uneven polishing action along the edge of the tip to produce undesirable highs and lows thereon Distance from punch tip to cathode screen: 1 ⅜–1 ½ inch Distance from side of punch to side of screen: 1–1 ½ inch In another experiment with a single tool under identical conditions to those set forth above excepting that the tool was positioned in the electrolyte at a 45° angle to the vertical, the results were good but not as good as obtained when the tool is held vertical as shown in the drawings.

In other experiments under conditions identical to those set forth above excepting that the tool was not moved in the electrolyte, the results were reasonably good but not as good as under the conditions set forth above.

In several other experiments where the voltage was of the order of 4 to 9 volts and the temperature of the electrolyte was of the order of 84°–89° C. and without agitation of the tool in the electrolyte, the results ranged from poor to only moderately good.

Why the method works better with the tooling in a vertical position as compared to holding it in a 45° position is not known, but the results set forth above have been definitely observed and hence this is believed to be a critical feature of the invention. The agitation is, of course, desirable as in other electrochemical operations to remove products of electrolysis, such as gas bubbles, from adjacent the tool anode.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a machine for electropolishing the working face of a tool used to compress medicinal powders into a tablet, the combination comprising:

a tank for receiving an electrolyte;

cathode means within said tank and conductor means including a connection to terminal means exteriorly of said tank;

clamp means above said tank for simultaneously engaging a plurality of said tools and arranged for nonrotatably holding said tools in parallel relationship wherein their axes are vertical relative to the horizontal;

means including said terminal means for imposing an electrical potential between said cathode means and said tools;

means supporting said clamp means, and the tools mounted thereon, for horizontal planar movement relative to said tank; and drive means for causing cyclic and repetitive horizontal translatory movement of said clamp means, and of the tools mounted thereon, through a horizontally planar pattern so that the axes of said tools are sidewardly displaced relative to said tank.

2. A machine according to claim 1, wherein said drive means causes translatory movement of said clamp means, and of the tools mounted thereon, along a substantially horizontal circular path, said clamp means maintaining the individual tools nonrotatable during said translatory movement.

3. In a machine for electropolishing the working face of a tool used to compress medicinal powders into a tablet, the combination comprising:

a tank for receiving an electrolyte;

cathode means within said tank and conductor means including a connection to terminal means exteriorly of said tank;

clamp means above same tank for engaging said tool and arranged for holding same with its axis in vertical alignment relative to the horizontal;

said clamp means comprising a generally horizontally aligned base plate having an opening therethrough for the reception of said tool, and a clamp on said base plate for holding said tool firmly thereagainst;

means including said terminal means for imposing an electrical potential between said cathode means and said tool; and means including prime mover means for moving said clamp means through a horizontally planar pattern.

4. The machine defined in claim 3 wherein said clamp comprises a clamp plate above and generally parallel with said base plate for bearing against the upper end of said tool and urging same against said base plate; and manually tightenable means for urging said clamp plate toward said base plate.

5. The machine of claim 4 wherein said tool has a head thereon of a diameter larger than the shank thereof and wherein the opening in said base plate is of size to admit said shank but not said head whereby said head may be urged against said base plate solely by downward pressure exerted thereon by said clamp plate.

6. The machine of claim 5 wherein the clamp plate and at least that portion of said base plate which contacts said head are made of a material of relatively low electrical resistivity.

7. In a machine for electropolishing the working face of a tool used to compress medicinal powders into a tablet, the combination comprising:

a tank for receiving an electrolyte;

cathode means within said tank and conductor means including a connection to terminal means exteriorly of said tank;

clamp means above said tank for engaging said tool and arranged for holding same with its axis in vertical alignment relative to the horizontal;

means including said terminal means for imposing an electrical potential between said cathode means and said tool;

movable eccentric means connected to said clamp means for moving said clamp means through a horizontally planar pattern; and means including prime mover means for driving said eccentric means.

8. The machine of claim 7 wherein said eccentric means also supports at least one portion of said base plate and including also means for supporting the remainder of said base plate and permitting movement thereof in said pattern.

9. The machine of claim 8 wherein said pattern is a horizontally planar circle.

10. In a method for electropolishing the working face of each of a plurality of elongated tools, each having a working face at the lower end thereof and used for compressing medicinal powders to form a tablet, comprising the steps of:

holding said plurality of tools in parallel and horizontally spaced relationship so that the individual tools are vertically positioned while the working faces located at the lower ends of said tools are immersed in an electrolyte;

imposing across said working faces and through said electrolyte an electrical potential; and simultaneously moving said plurality of tools with a horizontal translatory motion along a horizontal looplike pattern while holding the individual tools nonrotatable but with the working surfaces thereof immersed in said electrolyte.

11. A method according to claim 10, wherein the plurality of tools are cyclically moved with said horizontal translatory movement along said looplike path at the rate of between 75 and 95 loops per minute.

* * * * *